US008737885B1

(12) United States Patent
Berg

(10) Patent No.: US 8,737,885 B1
(45) Date of Patent: May 27, 2014

(54) DIGITAL PRINTER FOR PRINTING TO A RECORDING MEDIUM

(71) Applicant: Martin Berg, Poing (DE)

(72) Inventor: Martin Berg, Poing (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/025,908

(22) Filed: Sep. 13, 2013

(30) Foreign Application Priority Data

Dec. 5, 2012 (DE) ..... 10 2012 111 791

(51) Int. Cl.
*G03G 15/10* (2006.01)

(52) U.S. Cl.
USPC ..... 399/249

(58) Field of Classification Search
USPC ..... 399/237, 249
See application file for complete search history.

(56) References Cited

U.S. PATENT DOCUMENTS

| | | | | |
|---|---|---|---|---|
| 6,876,822 | B2 * | 4/2005 | Sasaki et al. | 399/237 X |
| 8,099,030 | B2 | 1/2012 | Berg et al. | |
| 2012/0014709 | A1 | 1/2012 | Pohlt | |
| 2012/0294653 | A1 * | 11/2012 | Gomi et al. | 399/249 |

FOREIGN PATENT DOCUMENTS

| | | |
|---|---|---|
| DE | 197 32 060 | 1/1999 |
| DE | 10 2005 055 156 | 5/2007 |
| DE | 10 2010 036 480 | 1/2012 |

* cited by examiner

*Primary Examiner* — Sandra Brase
(74) *Attorney, Agent, or Firm* — Schiff Hardin LLP

(57) ABSTRACT

In a digital printer a developer element is provided that inks charge images on a charge image carrier with toner. A feed system is provided to apply liquid developer with the toner onto the developer element. The cleaning unit is provided with a cleaning element to clean off residual liquid developer remaining on the developer element after the development of the charge images. A scraping unit rests on the cleaning element made up of a double blade arranged in a blade mount. The double blade provides a cleaning blade and a sealing blade that together form a blade chamber that is filled with fluid. The cleaning blade has at least one row of holes adjacent to a blade edge of the cleaning blade.

10 Claims, 9 Drawing Sheets

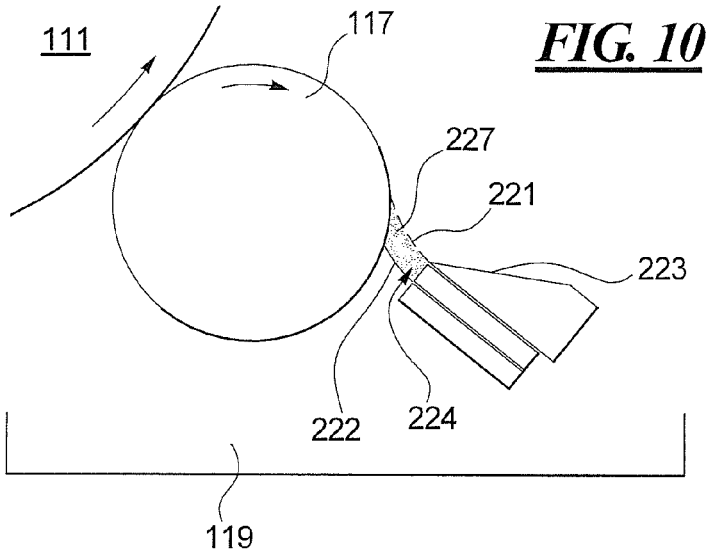
FIG. 10
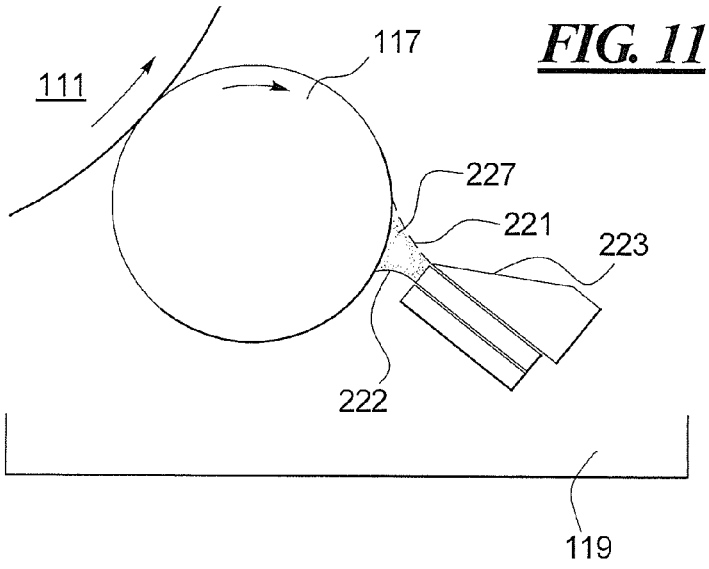
FIG. 11
FIG. 12
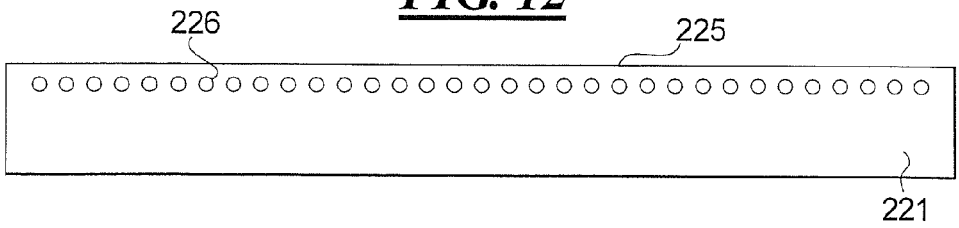

DIGITAL PRINTER FOR PRINTING TO A RECORDING MEDIUM

BACKGROUND

The disclosure concerns a digital printer for printing to a recording medium with toner particles that are applied with the aid of a liquid developer, in particular a high-speed printer for printing to web-shaped or sheet-shaped recording media.

In such digital printers, a latent charge image of a charge image carrier is inked by means of electrophoresis, with the aid of a liquid developer. The toner image that is created in such a manner is transferred indirectly (via a transfer element) or directly to the recording medium. The liquid developer has toner particles and carrier fluid in a desired ratio. Mineral oil is advantageously used as carrier fluid. In order to provide the toner particles with an electrostatic charge, charge carrier substances are added to the liquid developer. Further additives are additionally added, for example, in order to achieve the desired viscosity or a desired drying behavior of the liquid developer.

Such digital printers have long been known, for example from DE 10 2010 015 985 A1, DE 10 2008 048 256 A1 or DE 10 2009 060 334 A1.

To ink the charge images on the charge image carrier, liquid developer is directed past the charge image carrier by a developer station. The developer station has a developer element (for example a developer roller) that directs the liquid developer past the charge image carrier; a feed system that feeds the liquid developer to the developer roller; and a cleaning unit that cleans off the residual liquid developer remaining on the developer roller after the inking of the charge images on the charge image carrier. The cleaning unit provides, for example, a cleaning roller that removes the residual liquid developer from the developer roller. An electric field thereby exists between developer roller and cleaning roller that promotes the transfer of the residual liquid developer, for example. The residual liquid developer can be scraped off the cleaning roller by a blade. No residual toner should thereby remain on the cleaning roller, since otherwise this could arrive at the developer roller again.

Developer stations with such cleaning units are known from the documents DE 10 2010 008 211 A1, DE 10 2004 032 922 A1 or DE 10 2009 005 371 A1, for example. Furthermore, given a rotation printing machine (DE 299 18 488 U1) it is known to arrange a cleaning blade system at a coating roller, which cleaning blade system comprises a working blade and a sealing blade, wherein the chamber that is thereby formed is filled with a cleaning fluid via which the coating roller is cleaned of contaminants. An ultrasonic vibration system in the chamber assists with the cleaning.

SUMMARY

It is an object to achieve a digital printer for printing to a recording medium, which digital printer has a high process stability given minimized stressing of the liquid developer due to low mechanical stress, and that has a high print quality due to consistent properties of the liquid developer. In particular, a cleaning unit for the developer element should be realized in the developer station (for example the developer roller) so that the cleaning of the developer element is optimal and the liquid developer is thereby less stressed.

In a digital printer a developer element is provided that inks charge images on a charge image carrier with toner. A feed system is provided to apply liquid developer with the toner onto the developer element. The cleaning unit is provided with a cleaning element to clean off residual liquid developer remaining on the developer element after the development of the charge images. A scraping unit rests on the cleaning element made up of a double blade arranged in a blade mount. The double blade provides a cleaning blade and a sealing blade that together form a blade chamber that is filled with fluid. The cleaning blade has at least one row of holes adjacent to a blade edge of the cleaning blade.

BRIEF DESCRIPTION OF THE DRAWINGS

FIG. 10 is a double blade, made up of a blade chamber, a cleaning blade and a sealing blade, into which the blades are slid;

FIG. 11 is a double blade, made up of a blade chamber and a cleaning blade and a sealing blade, into which the sealing blade is pulled; and FIG. 12 is an exemplary embodiment of a perforated cleaning blade.

DESCRIPTION OF EXEMPLARY EMBODIMENTS

Figure 1:
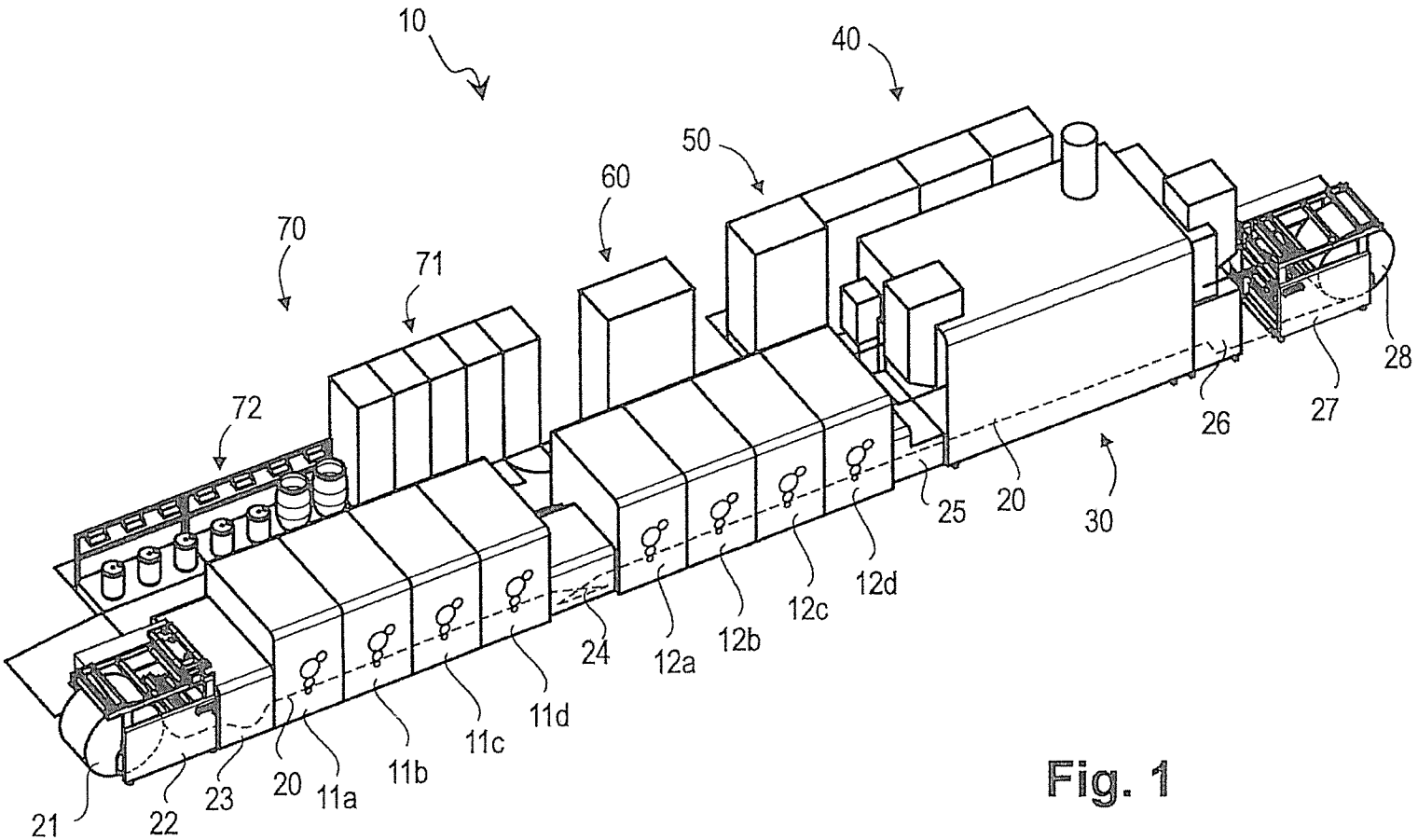
FIG. 1 is a view of a digital printer in an example configuration of the digital printer.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

The digital printer for printing to a recording medium has at least one print group with an electrophotography station to generate charge images of images to be printed on a charge image carrier, and with a developer station to ink the charge images on the charge image carrier using liquid developer.

For this, the developer station comprises

- a developer element (for example a developer roller or a continuous developer belt) that inks the charge images on the charge image carrier with toner,
- a feed system to apply the liquid developer onto the developer element,
- a cleaning unit
- with a cleaning element (for example a cleaning roller or a cleaning belt) to clean off the residual liquid developer remaining on the developer element after the development of the charge images, and with a scraping unit resting on the cleaning element that strips the remaining liquid developer from said cleaning element.

In one embodiment, the scraping unit can be executed as a double blade, thus as a unit made up of two blades (a cleaning blade and a sealing blade) that together form a blade chamber that is filled with fluid.

Furthermore, it is advantageous if the cleaning blade (of the double blade having a cleaning blade and a sealing blade) has at least one row of holes adjacent to its blade edge facing towards the cleaning element, through which row of holes the fluid can escape from the blade chamber. New fluid can be supplied laterally or from the rear of the blade chamber. Somewhat more fluid can thereby always be supplied than can be discharged via the holes of the cleaning blade. The discharge of the excess quantity can take place laterally or to the rear. It is therefore ensured that the holes of the row of holes of the cleaning blade always have liquid flowing through them so that the fluid can be continuously exchanged. The formation of deposits under the cleaning blade over a long time period is therefore prevented. Small damaged points on the blade edge also do not lead to damaging deposits of toner under the cleaning blade, and this therefore leads to lower wear.

It is advantageous if the scraping unit is arranged on a blade mount borne such that it can rotate, which blade mount exerts a pre-tension on the scraping unit in the direction of the cleaning element. Given a newly inserted blade, the blade then rests with its edge on the cleaning element under an increased pre-tension, wherein an increased wear on the scraping unit is presented only at the beginning in the rotation of the cleaning element. The scraping unit is subsequently subject to such a pre-tension at the cleaning element in which the wear at the scraping unit is low, such that the scraping unit achieves a long service life.

The embodiment of the scraping unit as a flushed double blade with perforated cleaning blade has particular advantages:

- The heating of the blades (and therefore a cementing of the toner) is avoided.
- The sealing blade serves to secure against re-entry of possibly present agglomerates that have arrived through the cleaning blade.
- The fluid escaping via the cleaning blade serves as a gliding film for the cleaned-off toner. Toner accumulations at the blade edge of the cleaning blade are therefore counteracted. The agglomerates can slide into a collection container arranged below the double blade and be drawn off there.
- Due to this function of the double blade, a liquid developer can be processed that has a high degree of cohesion at high toner concentration. A high degree of cohesion is advantageous in the transfer-printing to the recording medium, for example.
- The cleaned-off toner is flushed by the fluid from the blade mount of the double blade and therefore is exposed to less stress. Exemplary embodiments of the invention are explained in detail in the following using the schematic drawings.

According to FIG. 1, a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium 20 as the recording medium is unwound from a roll 21 with the aid of an unroller 22 and supplied to the first print group 11*a*. The print image 20' is fixed on the recording medium 20 in a fixing unit 30. The recording medium 20 can subsequently be rolled up on a roll 28 with the aid of a take-up roller 27. Such a configuration is also designated as a roll-to-roll printer.

In the preferred configuration shown in FIG. 1, the web-shaped recording medium 20 is printed in full color on the front side with four print groups 11*a* through 11*d* and on the back side with four print groups 12*a* through 12*d*. For this, the recording medium 30 is unrolled from the roll 21 by the unroller 22 and is supplied via an optional conditioning group 23 to the first print group 11*a*. In the conditioning group 23, the recording medium 20 can be pretreated or coated with a suitable substance. Wax or chemically equivalent substances can advantageously be used as a coating substance (also designated as a primer).

This substance can be applied over the entire area, or only to the locations of the recording medium 20 that are to be printed later, in order to prepare the recording medium 20 for the printing and/or to affect the absorption behavior of the recording medium 20 upon the apparatus of the print image 20'. It is therefore prevented that the toner particles or the carrier fluid that are applied later do not penetrate too much into the recording medium 20, but rather remain significantly on the surface (color and image quality is thereby improved).

The recording medium 20 is subsequently initially supplied in order to the first print groups 11*a* through 11*d* in which only the front side is printed. Each print group 11*a*-11*d* typically prints to the recording medium 20 in a different color or also with a different toner material (for example MICR toner, which can be read electromagnetically).

After printing to the front side, the recording medium 20 is turned in a turning unit 24 and supplied to the remaining print groups 12*a*-12*d* for printing to the back side. Optionally, an additional conditioning group (not shown) can be arranged in the region of the turning unit 24, via which the recording medium 20 is prepared for printing to the back side—for example a fixing (partial fixing) or other conditioning of the previously printed front side print image (or of the entire front side or even back side). It is thus prevented that the front side print image is mechanically damaged in the further transport through the subsequent print groups.

In order to achieve a full color printing, at least four colors (and therefore at least four print groups 11, 12) are required, and in fact the primary colors YMCK (yellow, magenta, cyan and black), for example. Additional print groups 11, 12 with special colors (for example customer-specific colors or additional primary colors in order to expand the printable color space) can also be used.

Arranged after the print group 12*d* is a register unit 25 via which registration marks—that are printed on the recording medium 20 independent of the print image 20' (in particular outside of the print image 20')—are evaluated. The transversal and longitudinal registration (the primary color points that form a color point should be arranged atop one another or spatially very close to one another; this is also designated as color register or four-color register) and the register (front side and back side must spatially coincide precisely) can therefore be adjusted so that a qualitatively good print image 20' is achieved.

Arranged after the register unit 25 is the fixer unit 30 via which the print image 20' is fixed on the recording medium 20. In electrophoretic digital printing, a thermal dryer is advantageously used as a fixer unit 30, which thermal dryer for the most part evaporates the carrier fluid so that only the toner particles remain on the recording medium 20. This occurs under the effect of heat. The toner particles can thereby also be fused to the recording medium 20 insofar as they have a material (resin, for example) that can be melted as a result of thermal action.

Arranged after the fixer unit 30 is a feed group 26 that draws the recording medium 20 through all print groups 11*a*-12*d* and the fixing unit 30 without an additional drive being arranged in this region. The danger that the not-yet fixed print image 20' could be smeared would exist due to a friction drive for the recording medium 20.

The feed group 26 supplies the recording medium 20 to the take-up roller 27 that rolls up the printed recording medium 20.

Centrally arranged in the print groups 11, 12 and the fixer unit 30 are all supply devices for the digital printer 10, such as climate control modules 40, power supply 50, controller 60, fluid management modules 70 (such as fluid control unit 71 and reservoir 72 of the various fluids). Hereby required as fluids are in particular pure carrier fluid, highly concentrated liquid developer (higher proportion of toner particles in relation to the carrier fluid) and serum (liquid developer plus charge control substances) in order to supply the digital printer 10, as well as waste containers for the fluids to be disposed of or containers for cleaning fluid.

The digital printer 10 has a modular design with its structurally identical print groups 11, 12. The print groups 11, 12 do not differ mechanically but rather via the liquid developer (toner color or toner type) that is used therein.

Figure 2:
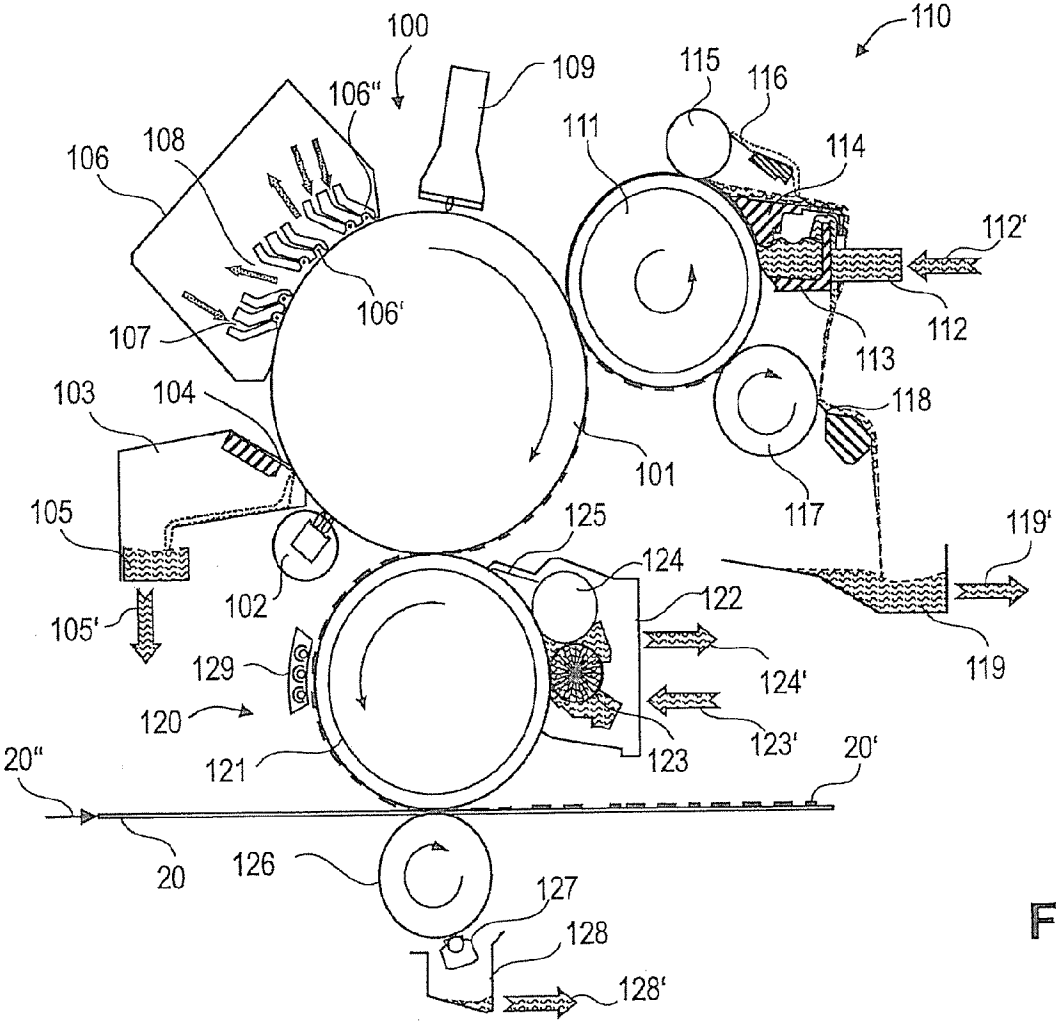
FIG. 2 is a schematic design of a print group of the digital printer according to FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a way is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in direction of the arrow).

The photoconductor is initially cleaned of all contaminants. For this, a canceling light 102 is present that cancels charges still remaining on the surface of the photoconductor. The canceling light 102 is adjustable (can be set locally) in order to achieve a homogeneous light distribution. The surface can therefore be pretreated uniformly.

After the canceling light 102, a cleaning device 103 mechanically cleans the photoconductor in order to remove possible dust particles present on the surface of the photoconductor and remaining carrier fluid. The cleaned-off carrier fluid is supplied to a collection container 105. The collected carrier fluid and toner particles are prepared (possibly filtered) and, depending on the color, supplied to a corresponding fluid ink reservoir, i.e. to one of the reservoirs 72 (see arrow 105').

The cleaning device 103 advantageously has a blade 104 that rests on the shell of the photoconductor roller 101 at an acute angle (for instance 10° to 80° relative to the exit surface) in order to mechanically clean the surface. The blade 104 can move back and forth transversal to the rotation direction of the photoconductor roller 101 in order to clean the shell over the entire axial length with as little wear as possible.

The photoconductor is subsequently charged by a charging device 106 to a predetermined electrostatic potential. Multiple corotrons (in particular glass sheath corotrons) are advantageously present for this. The corotrons comprise at least one wire 106' at which a high electric voltage is applied. The air around the wire 106' is ionized by the voltage. A shield 106" is present as a counter-electrode. The corotrons are additionally flushed with fresh air that is supplied via special air channels (ventilation channel 107 for aeration and exhaust channel 108 for venting) between the shields (see also air flow arrows in FIG. 2). The supplied air is then ionized uniformly at the wire 106'. A homogeneous, uniform charging of the adjacent surface of the photoconductor is thereby achieved. The uniform charging is further improved with dry and heated air. Air is exhausted via the exhaust channels 108. Ozone that is possibly created can likewise be drawn off via the exhaust channels 108.

The corotrons can be cascaded, meaning that two or more wires 106' are then present per shield 106" at the same shield voltage. The current that flows over the shield 106" is adjustable, and the charge of the photoconductor can thereby be controlled. The corotrons can be fed with current of different strengths in order to achieve a uniform and sufficiently high charge at the photoconductor.

Arranged after the charging device 106 is a character generator 109 that discharges the photoconductor per pixel depending on the desired print image 20' via optical radiation. A latent image thereby arises that is later inked with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical imaging points on the photoconductor determine the resolution of the print image 20' (typical resolution is 600×600 dpi). The LEDs can be controlled individually in time and with regard to their radiation power. Multilevel methods can thus be applied to generate raster points (comprising multiple image points or pixels), or image points can be delayed in order to implement corrections electro-optically, for example given incorrect color register or other registration.

The character generator 109 has a control logic that must be cooled due to the plurality of LEDs and their radiation power. The character generator 109 is advantageously liquid-cooled. The LEDs can be controlled in groups (multiple LEDs assembled into one group) or separately from one another.

The latent image generated by the character generator 109 is inked with toner particles by the developer station 110. For this the developer station 110 has a rotating developer roller 111 that directs a layer of liquid developer past the photoconductor (the functionality of the developer station 110 is explained in detail further below). Since the surface of the photoconductor roller 101 is relatively hard, the surface of the developer roller 111 is relatively soft, and when the two are pressed against one another a thin, high nip (a gap between the rollers) is created in which the charged toner particles migrate electrophoretically from the developer roller 111 to the photoconductor at the image points due to an electric field. No toner passes to the photoconductor in the non-image points. The nip filled with liquid developer has a height (thickness of the gap) that is dependent on the mutual pressure of the two rollers 101, 111 and the viscosity of the liquid developer. The thickness of the nip is typically in a range of (for instance) greater than 2 μm to (for instance) 20 μm (the values can also change depending on the viscosity of the liquid developer). The length of the nip amounts to a few millimeters, for instance.

The inked image rotates with the photoconductor roller 101 up to a first transfer point at which the inked image is essentially completely transferred to a transfer roller 121. At the first transfer point (nip between photoconductor roller 101 and transfer roller 121), the transfer roller 121 moves in the same direction and advantageously with the same speed as the photoconductor roller 101. After the transfer of the print image 20' onto the transfer roller 121, the print image 20' (toner particles) can optionally be recharged or charged by means of a charging unit 129 (a corotron, for example) in order to be able to subsequently transfer the toner particles better onto the recording medium 20.

The recording medium 20 runs in the transport direction 20" between the transfer roller 121 and a counter-pressure roller 126. The contact region (nip) represents a second transfer point at which the toner image is transferred onto the recording medium 20. In the second transfer region, the transfer roller 121 moves in the same direction as the recording medium 20. The counter-pressure roller 126 also rotates in this direction in the region of the nip. The speeds of the transfer roller 121, the counter-pressure roller 126 and the recording medium 20 are matched to one another at the transfer point and are advantageously identical so that the print image 20' is not smeared. At the second transfer point, the print image 20' is electrophoretically transferred onto the recording medium 20 due to an electric field between the transfer roller 121 and the counter-pressure roller 126. Moreover, the counter-pressure roller 126 presses with a large mechanical force against the relatively soft transfer roller 121, whereby the toner particles also remain adhered to the recording medium 20 due to the adhesion.

Since the surface of the transfer roller 121 is relatively soft and the surface of the counter-pressure roller 126 is relatively hard, upon rolling a nip is created in which the toner transfer occurs. Unevennesses of the recording medium 20 can therefore be compensated so that the recording medium 20 can be printed to without gaps. Such a nip is also well suited in order to print to thicker or more uneven recording media 20, for example as is the case in printing packaging.

The print image 20' should in fact transfer completely to the recording medium 20; nevertheless, a few toner particles can undesirably remain on the transfer roller 121. A portion of the carrier fluid always remains on the transfer roller 121 as a result of the wetting. The toner particles that are possibly still present should be nearly completely removed via a cleaning unit 122 following the second transfer point. The carrier fluid located on the transfer roller 121 can also be removed completely or up to a predetermined layer thickness from the transfer roller 121 so that, after the cleaning unit 122 and before the first transfer point from the photoconductor roller 101 to the transfer roller 121, the same conditions prevail due to a clean surface or a defined layer thickness with liquid developer on the surface of the transfer roller 121.

This cleaning unit 122 is advantageously designed as a wet chamber with a cleaning brush 123 and a cleaning roller 124. In the region of the brush 123, cleaning fluid (carrier fluid or a separate cleaning fluid can be used, for example) is supplied via a cleaning fluid feed 123'. The cleaning brush 123 rotates in the cleaning fluid and thereby "brushes" the surface of the transfer roller 121. The toner adhering to the surface is thereby loosened.

The cleaning roller 124 lies at an electric potential that is opposite the charge of the toner particles. As a result of this, the electrically charged toner is removed from the transfer roller 121 by the cleaning roller 123. Since the cleaning roller 124 contacts the transfer roller 121, it also takes up carrier fluid remaining on the transfer roller 121 together with the supplied cleaning fluid. A conditioning element 125 is arranged at the discharge from the wet chamber. As shown, a retention plate that is arranged at an obtuse angle (for instance between 100° and 170° between plate and discharge surface) relative to the transfer roller 121 can be used as a conditioning element 125, whereby residues of fluid on the surface of the roller are nearly completely retained in the wet chamber and supplied to the cleaning roller 124 for removal via a cleaning fluid discharge 124' to a cleaning fluid reservoir (in the reservoirs 72) (not shown).

Instead of the retention plate, a dosing unit (not shown) can also be arranged there that, for example, has one or more dosing rollers. The dosing rollers have a predetermined clearance from the transfer roller 121 and remove so much carrier fluid that a predetermined layer thickness is set after the dosing rollers as a result of the squeezing. The surface of the transfer roller 121 is then not completely cleaned off; carrier fluid of a predetermined layer thickness remains over the entire surface. Removed carrier fluid is directed back to the carrier fluid reservoir via the cleaning roller 124.

The cleaning roller 124 itself is kept clean mechanically via a blade (not shown). Cleaned-off fluid including toner particles for all colors are captured via a central collection container, cleaned and supplied to the central cleaning fluid container for re-use.

The counter-pressure roller 126 is likewise cleaned by a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and (possibly cleaned via a fluid discharge 128') provided again to the printing process.

In the print groups 11 that print to the front side of the recording medium 20, the counter-pressure roller 126 presses against the unprinted side (and thus undried side) of the recording medium 20.

Nevertheless, dust/paper particles or other soil particles can already be located on the dry side, which are then removed from the counter-pressure roller 126. For this, the counter-pressure roller 126 should be wider than the recording medium 20. As a result of this, contaminants outside of the printing region can also be cleaned off well.

In the print groups 12 that print to the back side of the recording medium 20, the counter-pressure roller 126 presses directly on the not yet fixed, damp print image 20' of the front side. So that the print image 20' is not removed by the counter-pressure roller 126, the surface of the counter-pressure roller 126 must have anti-adhesion properties with regard to toner particles, and also with regard to the carrier fluid on the recording medium 20.

The developer station 110 inks the latent print image 20' with a predetermined toner. For this, the developer roller 111 directs toner particles onto the photoconductor. In order to ink the developer roller 111 itself with a layer over its entire surface, liquid developer is initially supplied with a predetermined concentration from a mixing container (within the fluid control unit 71; not shown) via a fluid feed 112' to a storage chamber 112. From this storage chamber 112, the liquid developer is abundantly supplied to a pre-chamber 113 (a type of trough, open at the top). Towards the developer roller 111, an electrode segment 114 is arranged that forms a gap between itself and the developer roller 111.

The developer roller 111 rotates through the upwardly open pre-chamber 113 and thereby takes liquid developer along into the gap. Excess liquid developer runs from the pre-chamber 113 back to the storage chamber 112.

Due to the electrical field formed by the electrical potentials between the electrode segment 114 and the developer roller 111, the liquid developer is divided in the gap into two regions, and in fact into a layer region in proximity to the developer roller 111 in which the toner particles are concentrated (concentrated liquid developer) and a second region in proximity to the electrode segment 114 that is low in toner particles (very low-concentration liquid developer).

The layer of liquid developer is subsequently transported further to a dosing roller 115. The dosing roller 115 squeezes out the upper layer of the liquid developer so that a defined layer thickness of liquid developer of approximately 5 μm thickness subsequently remains on the developer roller 111. Since the toner particles are essentially located near the surface of the developer roller 111 in the carrier fluid, the outlying carrier fluid is essentially squeezed out or held back and is ultimately directed back to a collection container 119, but not supplied to the storage chamber 112.

As a result of this, predominantly highly concentrated liquid developer is conveyed through the nip between dosing roller 115 and developer roller 111. A uniformly thick layer of liquid developer thus arises with approximately 40 percent by mass of toner particles and approximately 60 percent by mass of carrier fluid after the dosing roller 115 (the mass ratios can also fluctuate more or less depending on the printing process requirements). This uniform layer of liquid developer is transported in a nip between the developer roller 111 and the photoconductor roller 101. There the image points of the latent image are then electrophoretically inked with toner particles, while no toner passes to the photoconductor in the region of non-image points. Sufficient carrier fluid for electrophoresis is absolutely necessary. The fluid film divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 can again be coated with liquid developer under the same conditions and uniformly, remaining toner particles (these essentially represent the negative, untransferred print image) and liquid developer are removed electrostatically and mechanically by a cleaning roller 117. The cleaning roller 117 itself is cleaned by a blade 118. The cleaned-off liquid developer is supplied to the collection container 119 for re-use, to which is also supplied liquid developer cleaned off from the dosing roller 115 by means of a blade 116 and liquid developer cleaned off of the photoconductor roller 101 by means of the blade 104.

The liquid developer collected in the collection container 119 is supplied to the mixing container via the fluid discharge 119'. Fresh liquid developer and pure carrier fluid are also supplied as needed to the mixing container. Sufficient fluid in the desired concentration (predetermined ratio of toner particles to carrier fluid) must always be present in the mixing container. The concentration in the mixing container is continuously measured and regulated accordingly depending on the feed of the amount of cleaned-off liquid developer and its concentration, as well as on the amount and concentration of fresh liquid developer or carrier fluid.

For this, highly concentrated liquid developer, pure carrier fluid, serum (carrier fluid and charge control substances in order to control the charge of the toner particles) and cleaned-off liquid developer can be separately supplied from the corresponding storage containers 72 to this mixing container.

Figure 3:
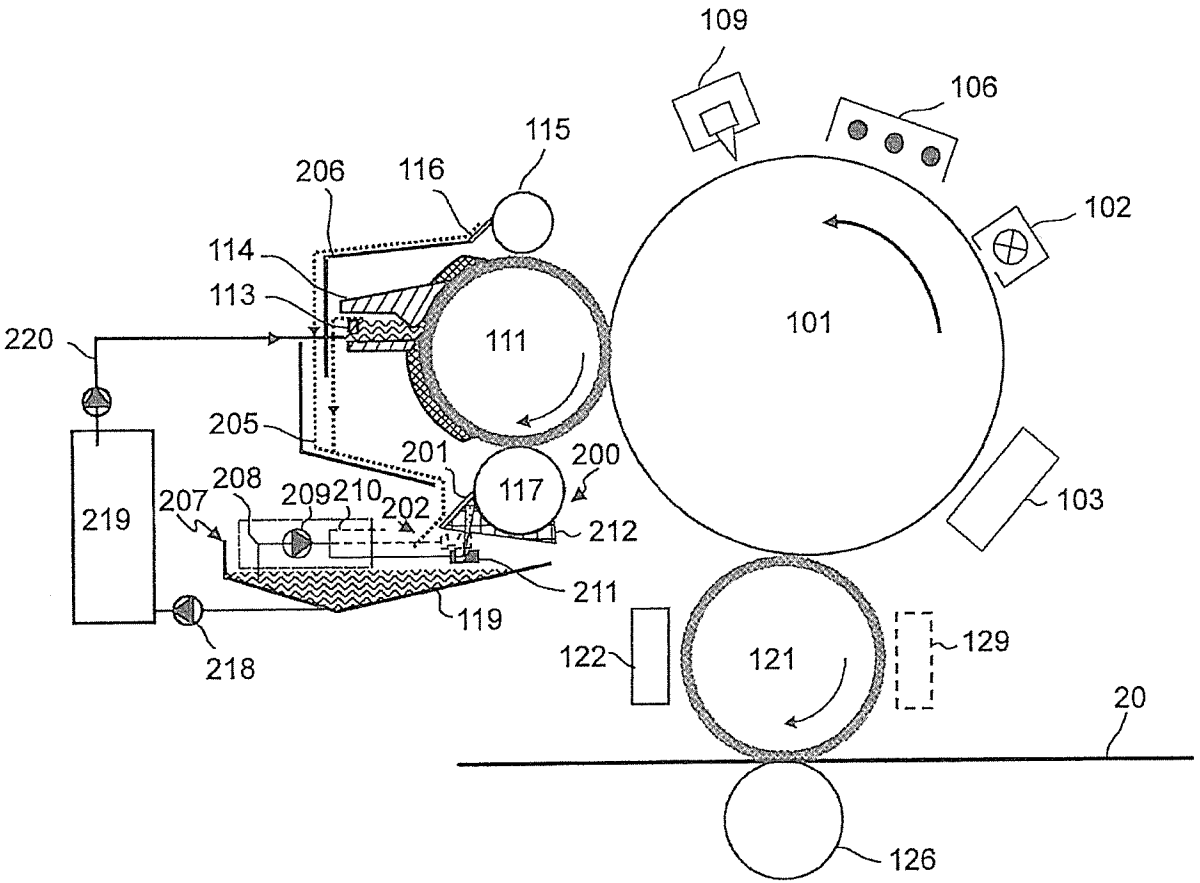
FIG. 3 is a print group with a first design of a developer station.

An embodiment of a developer station with which liquid developer is supplied to the photoconductor roller 101 results from FIG. 3. The embodiment assumes the developer station 110 according to FIG. 2. The same components are therefore provided with the same reference characters. The developer station 110 according to FIG. 3 comprises:

A developer element (for example the developer roller 111 or a continuous developer belt) which is arranged in contact with the photoconductor roller 101; the developer roller 111 has an elastic coating with predetermined electrical conductivity.

A supply system 113, 114 with the electrode segment 113 and the pre-chamber 114 that is arranged on the developer roller 111, before the contact zone of developer roller 111 and photoconductor roller 101 (as viewed in the rotation direction of the developer roller 111).

A cleaning unit 200 with the cleaning roller 117 as a cleaning element, with a scraping unit 201 and with an application unit 202 that applies a fluid to the scraping unit 201. The cleaning element (the cleaning roller 117 or a cleaning belt) is arranged in contact with the developer roller 111 and removes residual liquid developer remaining on the developer roller 111 after the development of the charge images from said developer roller 111; this residual liquid developer is then scraped off of the cleaning roller 117 by the scraping unit 201 (for example by a blade 118 according to FIG. 2), wherein the application unit 202 ensures that the scraping unit 201 remains free of scraped-off residual liquid developer.

A dosing means can optionally be provided that can be executed as a dosing roller 115, possibly with a blade 116.

Respective electrical potentials are applied to the function elements (such as photoconductor roller 101, developer roller 111, electrode segment 114, cleaning roller 117, dosing roller 115), which electrical potentials change with the polarity of the toner charge (which can be positive or negative). In the following explanation, these definitions apply:

Potential 1 at a first function element is higher than potential 2 at a second function element; given a positive toner polarity, this means: higher positive.

Potential 1 at a first function element is higher than potential 2 at a second function element; given a negative toner polarity, this means: potential 1 is higher negative.

A positive toner charge is assumed in the following.

The supply system 113, 114 transports the liquid developer to the developer roller 111, wherein the amount of toner contained in the liquid developer is greater than is necessary for the inking of the charge images on the photoconductor roller 101. The toner concentration in the supplied liquid developer amounts to between 3% and 30%, for example, advantageously 5% to 12%. The dosing of the longitudinal amount can then take place between the dosing roller 115 and the developer roller 111. Contact pressure, hardnesses of the developer roller 111 and dosing roller 115 and their surface roughness thereby determine the feed rate of liquid developer through the nip between the developer roller 111 and the dosing roller 115, and therefore the layer thickness of the liquid developer at the photoconductor roller 101. The dosing roller 115 thereby always has a higher potential than the developer roller 111. It is therefore ensured that no toner is undesirably transferred to the dosing roller 115. At the same time, the toner concentration in the liquid developer layer is increased, for example to 20% to 60%, and a uniform toner distribution on the developer roller 111 is ensured. The conditioned liquid developer subsequently arrives in the contact zone between the developer roller 111 and the photoconductor roller 101; the charge images are inked there. The electrical potentials at the developer roller 111 and the photoconductor roller 101 are selected so that toner is transferred to the photoconductor 101 in the image points, and no toner is transferred to the photoconductor roller 101 in the non-image points.

The liquid developer remaining on the developer roller 111 after the development of the print image—called residual liquid developer in the following—is subsequently removed from the developer roller 111 by the cleaning roller 117.

In order to promote the transfer of toner from the developer roller 111 to the cleaning roller 117, the cleaning roller 117 lies at an electrical potential that is lower given positive toner charge than the potential at the developer roller 111. The resulting voltage between the developer roller 111 and the cleaning roller 117 lies in a range from 10 V to 2000 V, advantageously 50 V to 300 V.

Figure 4:
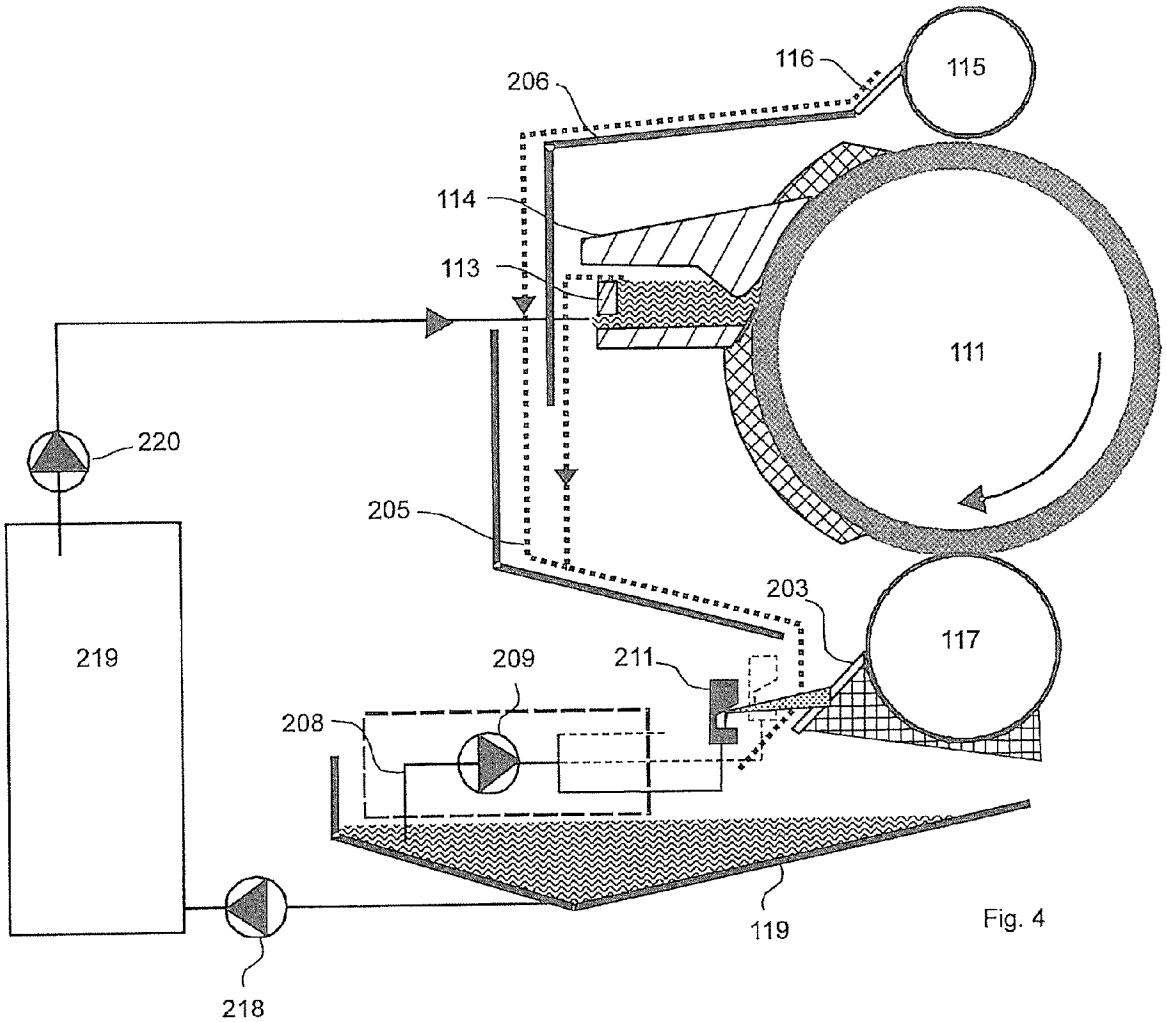
FIG. 4 is a second design of a developer station.
Figure 5:
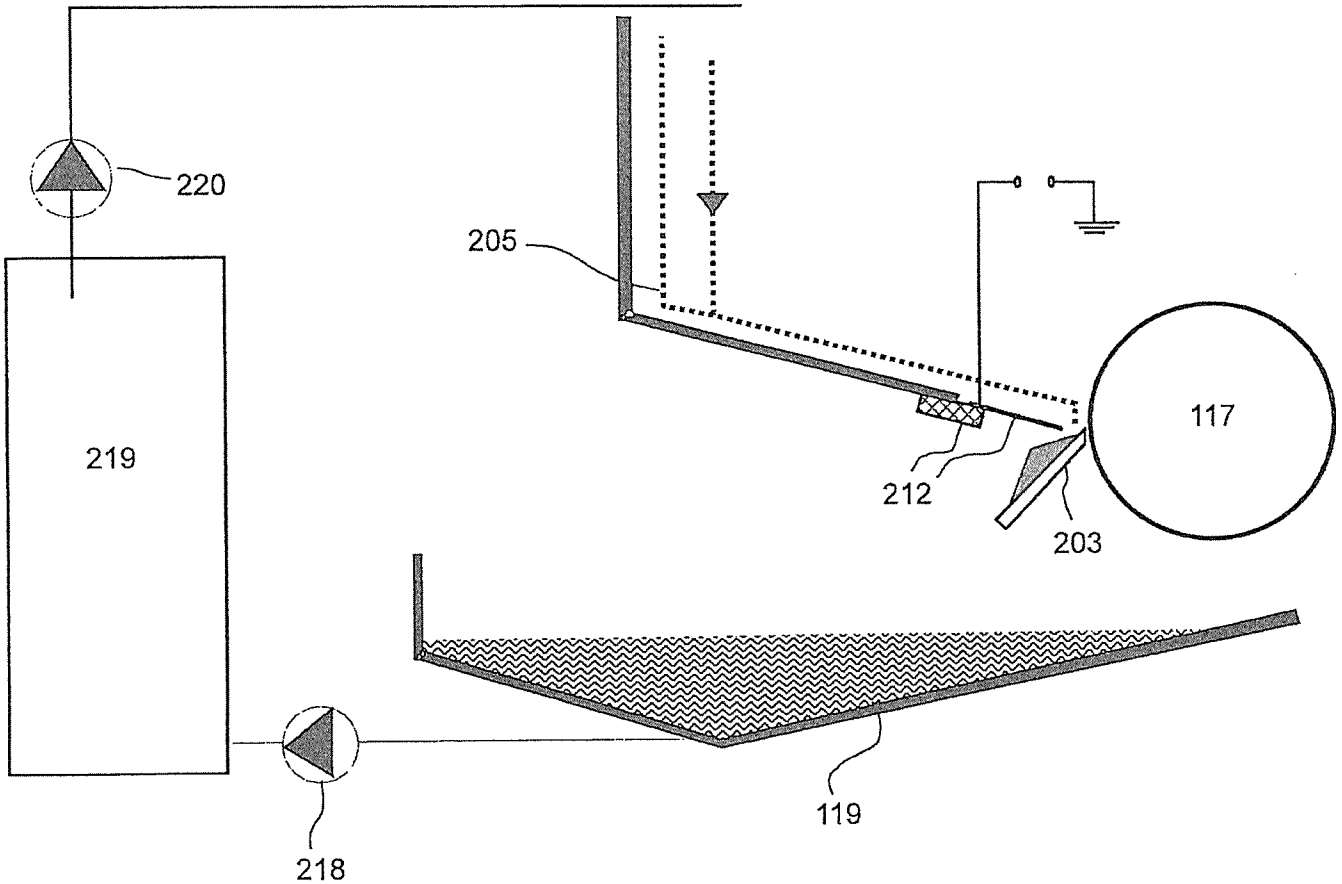
FIG. 5 is a cleaning unit.
Figure 6:
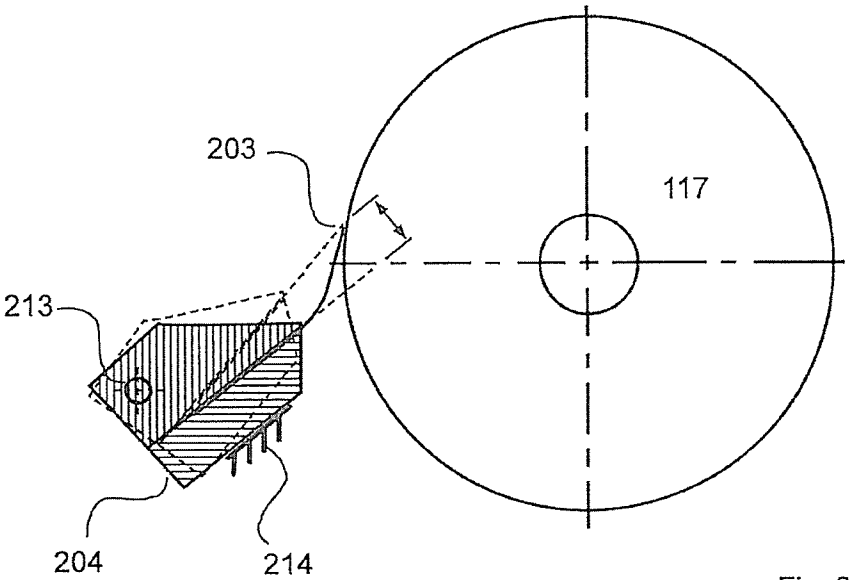
FIG. 6 is a mount for a blade.

The scraping unit 201, which removes the residual liquid developer from the cleaning roller 117, rests on said cleaning roller 117. The scraping unit 201 has at least one blade 203 (corresponds to blade 118 according to FIG. 2) that rests on the cleaning roller 117 in order to scrape the residual liquid developer off of the cleaning roller 117. The blade 203 is called a cleaning blade 203 in the following and is shown in FIGS. 4 through 6.

The cleaning blade 203 resting on the cleaning roller 117 is advantageously set to be field-free relative to the cleaning roller 117. For this, the cleaning blade 203 lies at the same electrical potential as the cleaning roller 117 and can then be supplied by the same power supply unit. The contact point of cleaning blade 203 to cleaning roller 117 is therefore potential-free, and no current flows across the contact point. This measure ensures that no wear-generating adhesion forces are generated between the cleaning blade 203 and the cleaning roller 117.

In the cleaning operation with the cleaning blade 203, the problem occurs that toner and toner components can arrive through the cleaning gap between the blade edge of the cleaning blade 203 and the cleaning roller 117 and then deposit as sediment after the cleaning blade 203; this in particular applies when the blade edge has a rough surface. The consequence is that the remaining liquid developer is no longer sufficiently scraped off by the cleaning blade 203 since the cleaning gap is increased by the deposits. In order to correct this problem, according to the exemplary embodiment the cleaning blade 203 is (as described in the following) flushed with a fluid (the liquid developer, for example) at least in the region of the blade edge. The layer of residual liquid developer located on the cleaning roller 117 is then completely removed by the cleaning blade 203. The scraped-off, residual liquid developer can be diverted into the collection container 119 (FIG. 2) via a blade mount 204 (FIG. 6). If the cleaning blade 203 and the blade mount 204 are executed to be smooth and are optionally, additionally coated with an anti-adhesive, the outflow of the residual liquid developer into the collection container 119 is facilitated.

In the following, the cleaning unit 200 is initially explained given the use of a scraping unit 201 with only one blade (the cleaning blade 203).

In order to completely remove the residual liquid developer from the cleaning roller 117 and in order to additionally ensure a long lifespan of the cleaning blade 203, in addition to the cleaning blade 203 the cleaning unit 200 provides the application unit 202 for a fluid that applies the fluid onto the cleaning blade 203 at least in the region of the contact zone between the cleaning blade 203 and the cleaning roller 117, in particular on the scraping edge of said cleaning blade 203. Liquid developer that should be low in toner is advantageously used as a fluid. The toner concentration of the residual liquid developer on the cleaning roller 117 is thereby lowered at the contact zone with the cleaning roller 117, and therefore the cohesion between the toner particles in the residual liquid developer is decreased.

Examples of an application unit 202 can be learned from FIGS. 3 through 9 that are explained in the following.

According to FIG. 3, the application unit 202 can have a flow guide element 205 (for example a flow channel) via which liquid developer is transported from the pre-chamber 113 to the cleaning blade 203. The flow guide element 205 can be connected with an overspill of the pre-chamber 113 so that excess liquid developer that is not transferred to the developer roller 111 is conducted via the flow guide element 205 to the cleaning blade 203. Liquid developer that is low in toner concentration can thereby be conducted to the cleaning blade 203 when the liquid developer in the pre-chamber is discharged at a point at which the liquid developer is low in toner due to the transfer of the toner to the developer roller 111.

If a dosing unit 115, 116 is arranged at the developer roller 111, the liquid developer that is removed from the developer roller 111 by the dosing means 115, 116 (and is likewise low in toner) can be supplied via a capture groove 206 to the flow guide element 205 and be used to clean the cleaning blade 203 (FIG. 3).

If the application unit 202 is arranged above the cleaning blade 203 (FIG. 3), the liquid developer can be directly conducted to the cleaning blade 203 without additional measures.

However, the application unit 202 can also have the collection container 119 that is filled with liquid developer. The liquid developer can then be discharged from the collection container 119 to the cleaning blade 203. For this, a flushing unit 207 can be used as an application means that can also be combined with the application unit 202 with the flow guide element 205 that is explained above.

In a first embodiment, the flushing unit 207 can provide the collection container 119 or a separate capture trough for the liquid developer and can additionally have a suction tube 208 beginning in the collection container 119; a suction unit 209 (a flushing pump, for example); a transport system 210, for example distributor hoses); and a distribution system 211 (flushing nozzles, for example). The flushing pump 209—for example a membrane pump—draws liquid developer from the collection container 119 via the suction tube 208 and pumps this to the flushing nozzles 211, which spray the liquid developer onto the cleaning blade 203, in particular onto its blade edge. The flushing nozzles 211 can be arranged relative to the cleaning blade 203 such that they spray the liquid developer onto the top of the cleaning blade 203 (FIG. 4) or onto the underside of the cleaning blade 203 (FIG. 3). The liquid developer draining from the cleaning blade 203 can be supplied again to the collection container 119. The number of flushing nozzles 211 is adapted to the width of the cleaning blade 203; for example, three flushing nozzles 211 can be provided. The flushing nozzles 211 can be executed as wide jet nozzles.

If the liquid developer is sprayed by the flushing unit 207 from above onto the blade edge of the cleaning blade 203 (FIG. 4), the toner of the residual liquid developer that is to be scraped off is loosened at the cleaning roller 117, and the toner layer can then more easily be flushed off. If the flushing unit 207 sprays the liquid developer onto the underside of the cleaning blade 203 (FIG. 3), toner residues that are not removed from the cleaning roller 117 can be flushed off the cleaning blade 203, and deposits on the cleaning roller 117 are avoided.

The use of a flushing unit 207 additionally has the advantage that the heat occurring at the scraping point is dissipated by the flushing.

The collection container 119 can be arranged in a circuit that leads via a pump 218 to a mixing container 219 that is connected via a pump 220 with the pre-chamber 113. The scraped-off liquid developer can then be supplied to the mixing container 219 and are mixed there with supplied new liquid developer.

In a development of the exemplary embodiment (FIG. 5), an electrical potential element 212 is arranged adjacent to the flow guide element 205, for example at the level of the contact line of cleaning blade 203/cleaning roller 117 and approximately 0.5 mm distant from said cleaning roller 117, wherein a positive potential greater than the potential at the cleaning roller 117 is applied to the potential element 212. The adhesion force of the toner relative to the cleaning roller 117 can thereby be reduced before the toner comes into contact with the cleaning blade 203. Via the action of the electrical field, the toner in the fluid layer is raised from the surface of the cleaning roller 117, and the stress on the toner particles at the scraping point is therefore reduced.

FIG. 6 shows an example of a blade mount 204 in which the cleaning blade 203 is attached. The blade mount 204 is borne so as to be rotatable on a rotation axle 213 so that the cleaning blade 203 can be placed on the cleaning roller 117 via rotation of the blade mount 204. After the placement of the cleaning blade 203 on the cleaning roller 117, the cleaning blade 203 is moved further (for example by 0.2 to 1 mm, advantageously by 0.8 mm) up to a stop 213 so that the cleaning blade 203 lies on the cleaning roller 117 under an increased pre-tension. After a slight initial wear of approximately 50 μm at the cleaning blade 203 in the initial cleaning operation, a force equilibrium arises between the blade pre-tension and the shear force for the cleaning. No further wear occurs at the cleaning blade 203, whose blade length remains unchanged.

In summary, the following setting values are advantageous for the cleaning unit 200 of FIG. 3 through 5:

- The cleaning blade 203 and the blade mount 204 can have a smooth surface; optionally, they can have a coating that is anti-adhesive with regards to the liquid developer.
- The electrical potential at the cleaning blade 203 and the cleaning roller 117 is selected to be the same so that the contact point of cleaning roller 117 with the cleaning blade 203 is potential-free, and no current flows across the contact point.
- The potential at the cleaning roller 117 is selected so that the toner is drawn from the developer roller 111 to the cleaning roller 117. The potential difference can be in the range from 10 V to 2000 V, advantageously in a range from 50 V to 300 V.

Figure 7:
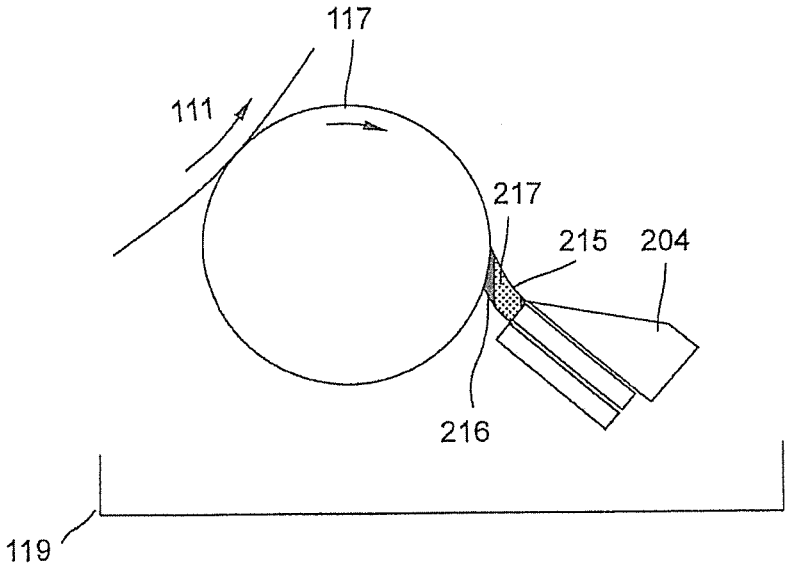
FIGS. 7 through 9 are additional cleaning units for a developer roller.
Figure 8:
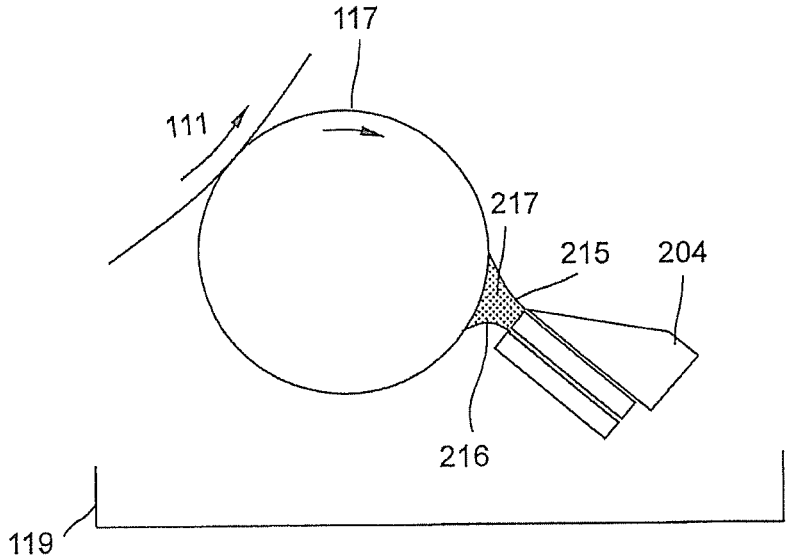
Figure 9:
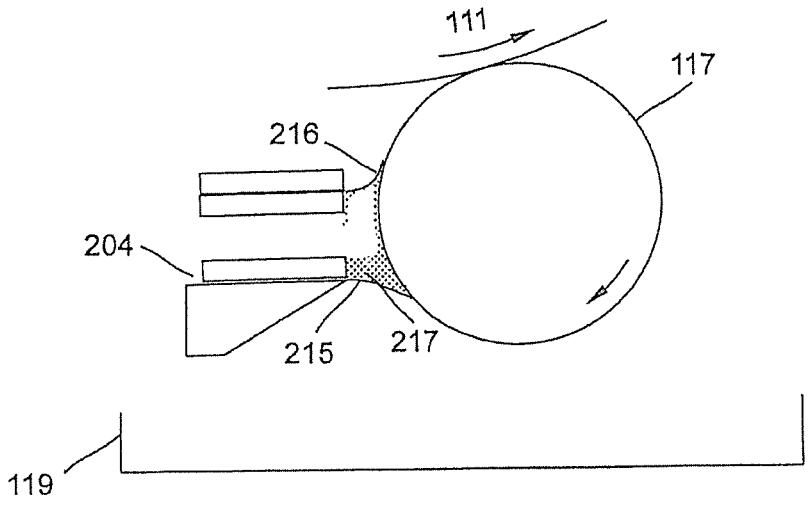

FIG. 7 through 9 show additional embodiments of the scraping unit 201. Here the scraping unit 201 is realized as a double blade made up of two blades 215, 216 arranged one after the other that together form a blade chamber 217. The first blade resting on the cleaning roller 117 (as viewed in the rotation direction of the cleaning roller 117) is the cleaning blade 215; the subsequent blade is called a sealing blade 216. The blade chamber 217 is filled up to the cleaning roller 117 with a fluid (liquid developer, for example). The cleaning blade 215 has the object of scraping the remaining liquid developer off of the cleaning roller 117 as completely as possible. The sealing blade 216 takes on two tasks: on the one hand, it ensures that the fluid is kept in the blade chamber 217; on the other hand, it ensures that the surface of the cleaning roller 117 is dried and completely cleaned after the sealing blade 216.

Due to the wetting of the insides of the blades 215, 216 via the fluid of the blade chamber 217 up to the contact zone of the blades 215, 216 with the cleaning roller 117, accumulations of toner and toner particles on the insides of the blades 215, 216 can be avoided, such that no residues of liquid developer can occur on the cleaning roller 117 after the sealing blade 216.

FIGS. 7 through 9 show three embodiments of the scraping unit 201 with cleaning blade 215 and sealing blade 216 in its arrangement relative to the cleaning roller 117. In FIG. 7, the scraping unit 201 is situated relative to the cleaning roller 117 such that both blades 215, 216 are shifted away from the cleaning roller 117. In FIG. 8, the sealing blade 216 is drawn out while the cleaning blade 215 is inserted. In FIG. 9, the scraping unit 201 are arranged rotated relative to FIG. 7.

The blades 215, 216 are attached in a blade mount 204 corresponding to FIG. 6. The collection container 119 can be arranged below the scraping unit 201.

FIG. 10 shows a further embodiment of a scraping unit 201 realized as a double blade which has a cleaning blade 221 and a sealing blade 222 that are arranged in a blade mount 223. The two blades 221, 222 form a blade chamber 224 that is filled by a fluid 227, for example mineral oil or mineral oil and toner. The blade chamber 224 is thereby filled with fluid up to the contact zones of the blades 221, 222 with the cleaning roller 117. Both blades 221, 222 are executed so as to be sliding in FIG. 10. In contrast to this, FIG. 11 shows a double blade made up of the cleaning blade 221 and the sealing blade 222 in which the sealing blade 222 is drawn away from the cleaning roller 117. The design of the cleaning blade 221 corresponds to that of FIG. 10.

The first blade (as viewed in the rotation direction of the cleaning roller 117)—the cleaning blade 221—is executed with perforations in the region of its blade edge 225 towards the cleaning roller 117. An example of a cleaning blade 221 with a row 226 of holes with holes adjacent to the edge 225 of the cleaning blade 221 is shown in FIG. 12. The row 226 of holes lies along the blade edge 225 and adjacent to the blade edge 225, such that fluid can escape via the holes of the row 226 of holes. The fluid in the blade chamber 224 can thereby be continuously exchanged; the feed can take place laterally or from the rear (not shown in FIG. 10, 11); the discharge of the fluid takes place via the holes of the row 226 of holes in the cleaning blade 221. The flow of the fluid through the holes of the row 226 of holes of the cleaning blade 221 has the effect that the residual toner cleaned off of the cleaning roller 117 by the cleaning blade 221 is reliably flushed away, for example into the collection container 119 that is arranged below the cleaning roller 117 and the double blade 221, 222. Agglomerations and cementing of residual toner in the region of the blade edge 225 of the cleaning blade 221 are thereby avoided.

The holes of the row 226 of holes in the cleaning blade 221 are arranged parallel to the blade edge 225 (for example at a distance of 3 to 20 mm from one another, advantageously at a distance of 5 to 15 mm), and lie approximately 1 to 3 mm distant from the blade edge 225. The diameter of the holes of the row 226 of holes can be between 0.5 and 2 mm, advantageously approximately 1 mm. The hole diameter is therefore much larger in comparison to the diameter of the toner particles, which can be 1 μm, for example. In FIG. 12, only one row 226 of holes is provided in the cleaning blade 221; however, multiple rows of holes 226 can also be arranged in the cleaning blade 221.

The sealing blade 222 seals the blade chamber 224 and ensures that the fluid 227 is kept in the blade chamber 224. Since the sealing blade 222 rests on the cleaning roller 117, it additionally cleans said cleaning roller 117 of residual toner that has possibly arrived via the cleaning blade 221; in addition to this, it ensures a dry surface of the cleaning roller 117 after the double blade 221, 222.

The embodiment of the scraping unit 201 as a double blade 221, 222 according to FIG. 10 through 12 results in additional advantages:

- The cleaning blade 221 is flushed by the fluid; a heating of the cleaning blade 221 is thereby avoided, and a cementing of the toner at the blade edge 225 of the cleaning blade 221 is prevented.

The sealing blade 222 serves as a safeguard against the re-entry of agglomerates that have possibly arrived via the cleaning blade 221. For example, the cleaning blade 221 has an efficiency of >99%; the sealing blade 222 then scraps off >99% of the residual toner that has arrived via the cleaning blade 221.

The fluid exiting from the cleaning blade 221 serves as a glide film for the cleaned-off toner. Toner accumulations directly at the blade edge 225 of the cleaning blade 221 are therefore counteracted.

The double blade 221, 222 allows a processing of developer mixture that has a high cohesion at high toner concentration.

By introducing the blade chamber 217, 224, the formation of deposits on the blade edges of the blades 215, 216 or 221, 222 is prevented even over a longer period of time. Even small damaged points at the blade edges of the blades 215, 216 or 221, 222 lead to no accumulations of toner and toner components at the blade edges. The service life of the blades 215, 216 or 221, 222 is thereby extended. Furthermore, it is possible to tolerate process fluctuations without problems occurring in the cleaning. Such process fluctuations can be fluctuations of the toner cohesion (for example due to lifespan variations, storage variations, production fluctuations), fluctuations of roller resistances (in particular of the developer roller 111), voltage fluctuations (in particular in the cleaning voltage) and toner concentration fluctuations.

The coating of the cleaning roller 117 can be selected as follows, for example:

The resistance can be between 0 and $10^{10}$ Ohm*cm.

The layer thickness can be between 10 and 400 μm, advantageously between 50 and 200 μm.

Materials can be: metal (hard chromium, tungsten carbide, hard coat) or ceramic (aluminum oxide, chromium oxide, titanium oxide or a mixture of these).

In summary, the developer station 110 with embodiments of the cleaning unit 200 according to the exemplary embodiment has the following advantages:

1) An excess conveyance in the toner application to the developer roller 111 is enabled via the supply system 113, 114; the supply of low-concentration liquid developer from the supply system 113, 114 to the cleaning zone between cleaning roller 117 and scraping unit 201 is thus possible so that a lowering of the toner concentration—including a loosening of the toner layer at the cleaning roller 117—is achieved.

2) The surface of the cleaning roller 117 can be produced to be smooth and wear-resistant; this leads to a uniform removal of the residual liquid developer from the developer roller 111;

to a low degree of adhesion of the toner particles to the cleaning roller 117 due to the low degree of roughness of the cleaning roller surface, to a good ability of the cleaning roller 117 to scrape off the toner particles without many toner particles or toner components coming under the blade edge. A reduced toner stress therefore results.

3) The smooth and anti-adhesive surface of cleaning blade 203, 215, 221 and its blade edge leads to:

a facilitated outflow of the scraped-off residual toner, therefore to a constant circulation of toner, which is in turn a requirement for a stable toner concentration for the supply system 113, 114.

4) The blade infeed via a dead stop 214 for the blade mount 204, 223 has the effect of a wear only at the beginning of the run time of a new cleaning blade 203, 215, 221;

that the wear is limited to a few μm so that a long service life of the cleaning blade 203, 215, 221 is achieved (>>100 h);

in combination with the smooth, wear-resistant surface of the cleaning roller 117, that a wear occurs only at the cleaning blade 203, 215, 221;

a uniform placement of the cleaning blade 203, 215, 221 on the cleaning roller 117.

5) The toner stress in the cleaning zone is reduced, and the stability is therefore improved, since the residence time of the residual liquid developer in proximity to the contact point of cleaning blade 203, 215, 221 with the cleaning roller 117 is reduced due to the flushing of the cleaning blade 203, 215, 221, since the loosening of the residual liquid developer on the cleaning roller 117 by the potential element 212 reduces the interaction at the contact point of cleaning blade 203, 215 with the cleaning roller 117.

6) The use of broad nozzles 211 in combination with a membrane pump 209 to reduce toner accumulations at the cleaning blade 203 allows the generation of a high pressure in the flushing of the cleaning blade 203, and therefore a high efficiency;

a function that is stable over a longer duration, without the risk of drying, since broad nozzles with a diameter >1 mm can be used that do not clog;

the generation of a spray jet at an angle of 0° to 150° relative to the infeed direction; a compact structural shape is therefore achieved.

7) The suction of the liquid developer from the collection container 119 to avoid toner accumulations at the cleaning blade 203 saves on the use of a second fluid. The toner concentration regulation is thereby not involved.

8) The uniform return of the residual liquid developer into the collection container 119, combined with the excess conveyance to the supply system 113, 114, has the effect that excess liquid developer can continuously flow to the cleaning unit 200, the pumping back from the collection container 119 into a mixing container 219 can take place discontinuously.

9) The flushing of the cleaning blade 203 (FIG. 3) has the effect that even small quantities of toner that have not been removed from the cleaning roller 117 by the cleaning blade 203 do not lead to an escalation. This increases the stability against process fluctuations and allows the correction of danger states, for example given intermittent failure of the toner concentration regulation.

The photoconductor can preferably be designed in the form of a roller or a continuous belt. An amorphous silicon as a photoconductor or an organic photoconductor material (also designated as an OPC) can thereby be used.

Instead of a photoconductor, other image carriers (such as magnetic, ionizable etc. image carriers) can also be used that do not operate according to the photoelectric principle, but rather on which latent images are impressed electrically, magnetically or otherwise according to other principles, which latent images are then inked and ultimately are transferred onto the recording medium 20.

LED lines or even lasers with corresponding scan mechanism can be used as a character generator 109.

The transfer element can likewise be designed as a roller or as a continuous belt. The transfer element can also be omitted. The print image 20' is then transferred directly from the photoconductor roller 101 onto the recording medium 20.

What is to be understood by the term "electrophoresis" is the migration of charged toner particles in the carrier fluid as a result of the action of an electrical field. In each transfer of toner particles, the corresponding toner particles transfer essentially completely to another element. After contact of the two elements, the fluid film is split approximately in half as the result of the wetting of the participating elements so that approximately one half remains adhered to the first element and the remaining part remains adhered to the other element. The print image 20' is transferred, and in the next part it is then transported further in order to allow an electrophoretic migration of the toner particles again in the next transfer region.

The digital printer 10 can have one or more print groups for the front-side printing and possibly one or more print groups for the back-side printing. The print groups can be arranged in a line, an L-shape or a U-shape.

Instead of the take-up roller 27, post-processing devices (not shown)—such as cutters, folders, stackers etc.—can also be arranged after the feed group 26 in order to bring the recording medium 20 into the final form. For example, the recording medium 20 could be processed so much that a finished book is created at the end. The post-processing devices can likewise be arranged in a row or offset from this.

As has previously been described as a preferred embodiment, the digital printer 10 can be operated as a roll-to-roll printer. It is also possible to cut the recording medium 20 at the end into sheets and to stack the sheets or process them further in a suitable manner (roll-to-sheet printer). It is likewise possible to supply a sheet-shaped recording medium 20 to the digital printer 10 and to stack or further process the sheets at the end (sheet-to-sheet printer).

If only the front side of the recording medium 20 is printed, at least one print group 11 with a color is required (simplex printing). If the back side is also printed, at least one print group 12 for the back side is furthermore required (duplex printing). Depending on the desired print image 20' on the front side and back side, the printer configuration includes a corresponding number of print groups for front side and back side, wherein each print group 11, 12 is always designed for only one color or one type of toner.

The maximum number of print groups 11, 12 is technically dependent on the maximum mechanical tensile load of the recording medium 20 and the free train length. Arbitrary configurations from a 1/0 configuration (only one print group for the front side to be printed) to a 6/6 configuration (in which six print groups are respectively present for front side and back side of the recording medium 20) can typically be present. The preferred embodiment (configuration) is shown in FIG. 1 (a 4/4 configuration) with which the full color printing for front side and back side is provided with four primary colors. The order of the print groups 11, 12 in a four color printing advantageously goes from a print group 11, 12 that prints light (yellow) to a print group 11, 12 that prints dark; for example, the recording medium 20 is thus printed to from light to dark in the color order Y-C-M-K.

The recording medium 20 can be produced from paper, metal, plastic or other suitable and printable materials.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A digital printer for printing to a recording medium, comprising:

at least one print group with a station to generate charge images of images to be printed on a charge image carrier, and a developer station to ink the charge images on the charge image carrier using liquid developer, the developer station having:

a developer element that inks the charge images on the charge image carrier with toner to develop the charge images, a feed system to apply the liquid developer onto the developer element, and a cleaning unit with a cleaning element to clean off residual liquid developer remaining on the developer element after the development of the charge images, and a scraping unit resting on the cleaning element made up of a double blade arranged in a blade mount, said double blade providing a cleaning blade and a sealing blade that together form a blade chamber that is filled with fluid, the cleaning blade having at least one row of holes adjacent to a blade edge of the cleaning blade.

2. The digital printer according to claim 1 wherein a diameter of the holes of the row of holes is chosen to be larger in comparison to a diameter of toner particles of the toner.

3. The digital printer according to claim 1 wherein a distance of the holes of the row of holes from one another is in a range from 3 to 20 mm.

4. The digital printer according to claim 1 wherein the row of holes is arranged parallel and adjacent to the blade edge of the cleaning blade.

5. The digital printer according to claim 4 wherein the row of holes is arranged at a distance of 1 to 3 mm from the blade edge of the cleaning blade.

6. The digital printer according to claim 1 wherein the blade chamber provides a supply point for supply of fluid and a supply point for discharge of fluid, wherein more fluid is supplied to the blade chamber than can discharge via the holes of the row of holes of the cleaning blade, wherein excess fluid drains away via the supply point for the discharge.

7. The digital printer according to claim 1 wherein the scraping unit and the cleaning element have a same electrical potential.

8. The digital printer according to claim 1 wherein the blade unit is attached to a blade mount borne such that it can rotate, said blade mount exerting a pre-tension on the scraping unit in a direction of the cleaning element.

9. The digital printer according to claim 1 wherein the cleaning blade and the sealing blade rest on the cleaning element such that they are pulled by said cleaning element.

10. The digital printer according to claim 1 wherein the cleaning blade and the sealing blade rest on the cleaning element such that the cleaning blade is pulled by the cleaning element and the sealing blade is pushed by the cleaning element.

* * * * *